US011073047B2

(12) United States Patent
Sugishita et al.

(10) Patent No.: US 11,073,047 B2
(45) Date of Patent: Jul. 27, 2021

(54) STEAM TURBINE

(71) Applicant: Mitsubishi Hitachi Power Systems, Ltd., Yokohama (JP)

(72) Inventors: Hideaki Sugishita, Tokyo (JP); Soichiro Tabata, Yokohama (JP); Toyoharu Nishikawa, Tokyo (JP); Tadashi Takahashi, Yokohama (JP); Kazuyuki Matsumoto, Tokyo (JP); Yoshihiro Kuwamura, Tokyo (JP)

(73) Assignee: MITSUBISHI POWER, LTD., Yokohama (JP)

( * ) Notice: Subject to any disclaimer, the term of this patent is extended or adjusted under 35 U.S.C. 154(b) by 0 days.

(21) Appl. No.: 16/634,223

(22) PCT Filed: Aug. 15, 2018

(86) PCT No.: PCT/JP2018/030340
§ 371 (c)(1),
(2) Date: Jan. 27, 2020

(87) PCT Pub. No.: WO2019/035463
PCT Pub. Date: Feb. 21, 2019

(65) Prior Publication Data

US 2020/0173309 A1 Jun. 4, 2020

(30) Foreign Application Priority Data

Aug. 15, 2017 (JP) ..... JP2017-156732

(51) Int. Cl.
*F01D 25/30* (2006.01)
*F01D 1/04* (2006.01)
(Continued)

(52) U.S. Cl.
CPC ..... *F01D 25/30* (2013.01); *F01D 1/04* (2013.01); *F01D 25/24* (2013.01); *F01D 9/02* (2013.01);
(Continued)

(58) Field of Classification Search
CPC ... F01D 1/04; F01D 9/02; F01D 25/24; F01D 25/30; F05D 2220/31
See application file for complete search history.

(56) References Cited

U.S. PATENT DOCUMENTS 3,120,374 A 2/1964 Herzog et al.
4,391,564 A * 7/1983 Garkusha ..... F01D 25/30 415/126
(Continued)

FOREIGN PATENT DOCUMENTS

DE 3042858 A1 6/1981
DE 102008037526 A1 5/2009
(Continued)

OTHER PUBLICATIONS

International Search Report dated Oct. 30, 2018, issued in counterpart Application Na PCT/JP2018/030340, with English translation. (4 pages).
(Continued)

*Primary Examiner* — Igor Kershteyn
(74) *Attorney, Agent, or Firm* — Westerman, Hattori, Daniels & Adrian, LLP

(57) ABSTRACT

A steam turbine (ST) includes a rotor (11) which is rotatable around an axis (Ar), an inner casing (21) surrounding the rotor (11) from an outer peripheral side, an outer casing (30) surrounding the rotor (11) and the inner casing (21) and defining an exhaust chamber between the inner casing (21) and the outer casing (30), the steam being exhausted to the exhaust chamber (30*s*), and a flow guide (27) which has a
(Continued)

tubular shape and is installed on one end portion of the inner casing 21 in an axial direction (Da) in the exhaust chamber (30*s*) to guide the steam discharged from the rotor (11). The flow guide (27) has a turning surface (RA) which is connected to an outer peripheral surface (27A) and turns a fluid flowing along the outer peripheral surface (27A) toward the other side in the axial direction (Da).

6 Claims, 7 Drawing Sheets

(51) Int. Cl.
*F01D 9/02* (2006.01)
*F01D 25/24* (2006.01)

(52) U.S. Cl.
CPC ..... *F05D 2220/31* (2013.01); *F05D 2240/14* (2013.01)

(56) References Cited

U.S. PATENT DOCUMENTS

| | | | | |
|---|---|---|---|---|
| 4,391,566 | A | 7/1983 | Takamura | |
| 6,419,448 | B1 * | 7/2002 | Owczarek | F01D 1/02 415/207 |
| 7,780,403 | B2 * | 8/2010 | Fridsma | F01D 17/14 415/148 |
| 7,980,055 | B2 * | 7/2011 | Lindenfeld | F01D 25/30 60/39.5 |
| 2009/0068006 | A1 * | 3/2009 | Hardin | F01D 25/30 415/211.2 |
| 2009/0123277 | A1 | 5/2009 | Dalsania et al. | |
| 2011/0164972 | A1 | 7/2011 | Mundra et al. | |
| 2012/0163969 | A1 | 6/2012 | Ongole et al. | |

FOREIGN PATENT DOCUMENTS

| | | | |
|---|---|---|---|
| GB | 2131100 | A | 6/1984 |
| JP | S52-153005 | A | 12/1977 |
| JP | S55-044013 | U | 3/1980 |
| JP | S59-105905 | A | 6/1984 |
| JP | S60-143109 | U | 9/1985 |
| JP | H11-200814 | A | 7/1999 |
| JP | 2003-027905 | A | 1/2003 |
| JP | 2006-083801 | A | 3/2006 |
| JP | 2006-329148 | A | 12/2006 |
| JP | 2007-064190 | A | 3/2007 |
| JP | 2007-291855 | A | 11/2007 |
| JP | 2011-137461 | A | 7/2011 |
| JP | 2011-220125 | A | 11/2011 |
| JP | 2012-132455 | A | 7/2012 |
| JP | 2018-071445 | A | 5/2018 |

OTHER PUBLICATIONS

Written Opinion dated Oct. 30, 2018, issued in counterpart Application No. PCT/JP2018/030340, with English translation. (13 pages).

* cited by examiner

STEAM TURBINE

TECHNICAL FIELD

The present invention relates to a steam turbine.

Priority is claimed on Japanese Patent Application No. 2017-156732, filed on Aug. 15, 2017, the content of which is incorporated herein by reference.

BACKGROUND ART

A steam turbine includes an exhaust casing which guides steam flowing out from a last rotor blade row of a turbine rotor to an outside. The exhaust casing includes a diffuser and an outer casing. The diffuser has an annular shape with respect to an axis and forms a diffuser space which gradually goes toward a radially outer side as the diffuser space goes toward an axially downstream side. The diffuser has an outer diffuser (steam guide or a flow guide) which defines a radially outer edge of the diffuser space and an inner diffuser (or bearing cone) which defines a radially inner edge of the diffuser space. The steam which has flowed out from the last rotor blade row of the turbine rotor flows into the diffuser space. The outer casing communicates with the diffuser and forms an exhaust space which guides the steam which has flowed in from the diffuser space to the outside such that an outer periphery of the diffuser spreads in a circumferential direction with respect to the axis.

As a specific example of the steam turbine having the configuration, a steam turbine described in Patent Document 1 below is known. In Patent Document 1, a diffuser is formed to include a cone disposed on a radially inner side and a guide disposed on an outer peripheral side of the cone. An outer casing is provided on a downstream side of the diffuser. Steam discharged from the diffuser hits the outer casing, and thus, is turned so as to go in a direction opposite to the main flow of the steam.

CITATION LIST

Patent Document

Patent Document 1: Japanese Unexamined Patent Application, First Publication No. 2011-220125

DISCLOSURE OF INVENTION

Technical Problem

Here, the guide extends in a direction intersecting a flow direction of the discharged steam. Accordingly, a circulation flow is formed in a region on an outer peripheral side (rear side) of the guide. Since the circulation flow is formed, a channel area effective for exhausting gas is reduced, and thus, a pressure recovery amount of the steam inside the diffuser is also reduced. That is, in the steam turbine described in Patent Document 1, an exhaust loss may increase.

The present invention is made to solve the above-described problems, and an object thereof is to provide a steam turbine capable of reducing the exhaust loss.

Solution to Problem

According to a first aspect of the present invention, there is provided a steam turbine including: a rotor which is rotatable around an axis by steam supplied to the rotor and which is configured to exhaust the steam from one side in an axial direction; an inner casing surrounding the rotor from an outer peripheral side; an outer casing surrounding the rotor and the inner casing and defining an exhaust chamber between the inner casing and the outer easing, the steam being exhausted to the exhaust chamber; and a flow guide which has a tubular shape surrounding the axis and which is installed on one end portion of the inner casing in the axial direction in the exhaust chamber so as to guide the steam discharged from the rotor, wherein the flow guide includes an inner peripheral surface which is formed so that the diameter thereof is enlarged as the inner peripheral surface is separated further from the inner casing to one side in the axial direction, an outer peripheral surface which is formed so that the diameter thereof is enlarged as the outer peripheral surface is separated further from the inner casing to the one side in the axial direction, and a turning surface which is connected to the outer peripheral surface and which is formed so as to turn a fluid flowing along the outer peripheral surface toward the other side in the axial direction.

According to this configuration, the fluid flowing along the outer peripheral surface is turned by the turning surface, and, thus, the fluid flows from the one side toward the other side in the axial direction. Accordingly, it is possible to reduce a size in a region of a circulation flow in the vicinity of the turning surface.

According to a second aspect, the turning surface may be extended from the one side to the other side in the axial direction as the turning surface goes from a radially inner side toward a radially outer side with respect to the axis.

According to this configuration, the fluid flowing along the outer peripheral surface is turned by the turning surface, and, thus, the fluid flows from the one side toward the other side in the axial direction. Accordingly, it is possible to reduce the size in the region of the circulation flow in the vicinity of the turning surface.

According to a third aspect of the invention, the steam turbine may further include a solid portion which is formed in a region between the turning surface and the inner peripheral surface so that the region is filled with the solid portion.

According to this configuration, since the flow guide including the solid portion can be formed integrally, the flow guide can be easily and inexpensively manufactured.

According to a fourth aspect of the present invention, in a cross-sectional view including the axis, the inner peripheral surface may have a curvature radius smaller than that of the turning surface, and an outer peripheral end edge of the turning surface may intersect an outer peripheral end edge of the inner peripheral surface.

According to this configuration, a flow direction of the fluid flowing along the inner peripheral surface and a flow direction of the fluid flowing along the turning surface can be made substantially the same as each other. Thereby, a mixing loss of the fluid flowing along the inner peripheral surface and the fluid flowing along the turning surface can be reduced.

According to a fifth aspect of the present invention, the steam turbine may further include a plurality of first rectifying fins which are formed on the turning surface and which are extended in a radial direction of the axis.

Here, a circumferential component of the axis accompanying a rotation of the rotor is included in a flow direction of the fluid discharged from a diffuser. According to the configuration, since the first rectifying fins are formed on the turning surface. Therefore, a circumferential component of the fluid discharged from the diffuser and a circumferential component of the circulation flow flowing along the turning surface can be made substantially the same as each other. Accordingly, an interference between the fluid discharged from the diffuser and the circulation flow can be reduced, and it is possible to reduce a mixing loss.

According, to a sixth aspect of the present invention, the steam turbine may further include a plurality of second rectifying fins which are formed on the inner peripheral surface and which are extended in a radial direction of the axis.

According to the configuration, since the second rectifying fins are formed on the inner peripheral surface, the flow along the inner peripheral surface and the circulation flow along the turning surface can be made closer to each other. Therefore, the interference between the fluid discharged from the diffuser and the circulation flow can be further reduced, and thus, it is possible to reduce the mixing loss.

Advantageous Effects of Invention

According to the present invention, it is possible to provide a steam turbine capable of reducing an exhaust loss.

BEST MODE FOR CARRYING OUT THE INVENTION

First Embodiment

Figure 1:
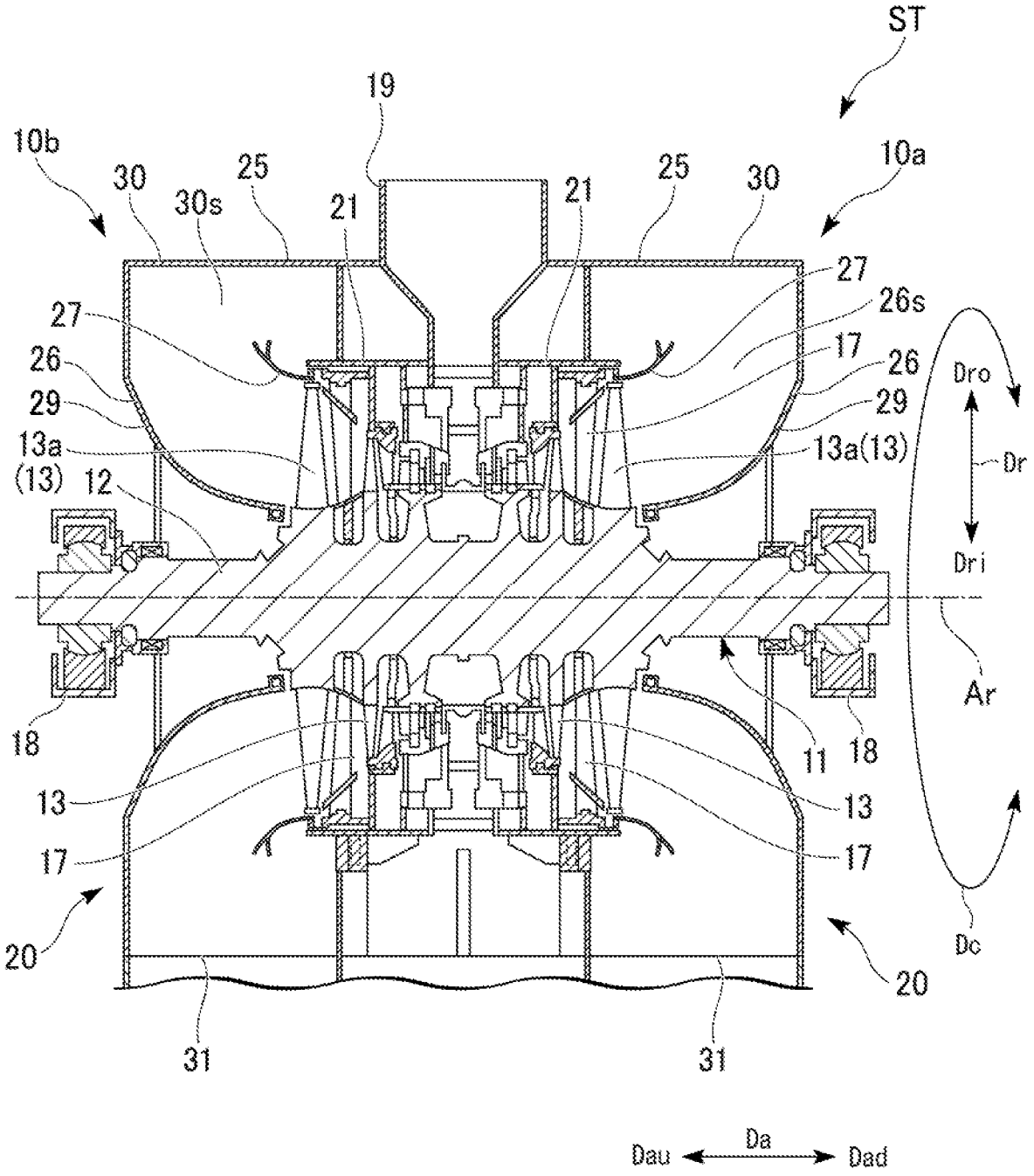
FIG. 1 is a sectional view of a steam turbine according to a first embodiment of the present invention.

A first embodiment of a steam turbine, according to the present invention will be described with reference to the drawings. A steam turbine ST of the first embodiment is a bifurcated exhaust type steam turbine. That is, as shown in FIG. 1, the steam turbine ST includes a first steam turbine section 10*a* and a second steam turbine section 10*b*. Each of the first steam turbine section 10*a* and the second steam turbine section 10*b* includes a turbine rotor 11 (rotor 11) which rotates about an axis Ar, a casing 20 which covers the turbine rotor 11, a plurality of stator blade rows 17 which are fixed to the casing 20, and a steam inflow pipe 19. Hereinafter, a circumferential direction centered on the axis Ar is simply referred to as a circumferential direction Dc, and a direction perpendicular to the axis Ar is referred to as a radial direction Dr. Further, in this radial direction Dr, a side closer to the axis Ar is a radially inner side Dri, and a side opposite to the radially inner side Dri is a radially outer side Dro.

The first steam turbine section 10*a* and the second steam turbine section 10*b* share the steam inflow pipe 19. In the first steam turbine section 10*a*, parts excluding the steam inflow pipe 19 are disposed on one side in the axial direction Da based on the steam inflow pipe 19. In the second steam turbine section 10*b*, parts excluding the steam inflow pipe 19 are disposed on the other side in the axial direction Da based on the steam inflow pipe 19. In each of the steam turbine sections 10*a*, 10*b*, in the above-described axial direction Da, a side of the steam inflow pipe 19 is referred to as an axially upstream side Dau, and a side opposite to the axially upstream side Dau is an axially downstream side Dad.

A configuration of the first steam turbine section 10*a* and a configuration of the second steam turbine section 10*b* are basically the same as each other. Accordingly, the first steam turbine section 10*a* will be mainly described below.

The turbine rotor 11 includes a rotor shaft 12 which extends in the axial direction Da about the axis Ar, and a plurality of rotor blade rows 13 which are attached to the rotor shaft 12. The turbine rotor 11 is supported by bearings 18 so as to be rotatable about the axis Ar. The plurality of rotor blade rows 13 are arranged in the axial direction Da. Each rotor blade row 13 includes a plurality of rotor blades arranged in the circumferential direction Dc. The turbine rotor 11 of the first steam turbine section 10*a* and the turbine rotor 11 of the second steam turbine section 10*b* are located on the same axis Ar to be connected to each other and rotate integrally around the axis Ar.

The casing 20 includes an inner casing 21 and an exhaust casing 25. The inner casing 21 forms a substantially conical space about the axis Ar. The plurality of rotor blade rows 13 of the turbine rotor 11 are disposed in this conical space. The plurality of stator blade rows 17 are arranged in the axial direction Da and disposed in the conical space. Each of the plurality of stator blade rows 17 is arranged on the axially upstream side Dau of any one of the plurality of rotor blade rows 13. The plurality of stator blade rows 17 are fixed to the inner casing 21.

The exhaust casing 25 has a diffuser 26 and an outer casing 30. The diffuser 26 has an annular shape with respect to the axis Ar, and forms a diffuser space 26*s* which gradually goes toward the radially outer side as the diffuser space 26*s* goes toward the axially downstream side Dad. Steam which has flowed out from a last rotor blade row 13*a* of the turbine rotor 11 flows into the diffuser space 26*s*. The last rotor blade row 13*a* is the rotor blade row 13 which is disposed on the most axially downstream side Dad among the plurality of rotor blade rows 13. The diffuser 26 has an outer diffuser 27 (flow guide 27) which defines an edge on the radially outer side Dro of the diffuser space 26*s*, and an inner diffuser 29 (bearing cone 29) which defines an edge on the radially inner side Dri of the diffuser space 26*s*. The outer diffuser 27 has an annular cross section perpendicular to the axis Ar, and gradually spreads toward the radially outer side Dro as the outer diffuser 27 goes toward the axially downstream side Dad. The inner diffuser 29 also has an annular cross section perpendicular to the axis Ar, and gradually spreads toward the radially outer side Dro as the inner diffuser 29 goes toward the axially downstream side Dad. The inner diffuser 29 is connected to the outer casing 30.

The outer casing 30 has an exhaust port 31. The exhaust port 31 opens in a vertically downward direction from the inside toward the radially outer side Dro. A condenser (not shown) for condensing the steam to water is connected to the exhaust port 31. That is, the steam turbine ST of the present embodiment is a downward exhaust type condensate steam turbine. The outer casing 30 forms an exhaust space 30*s* (exhaust chamber 30*s*) which communicates with the diffuser 26. The exhaust space 30*s* is formed such that an outer periphery of the diffuser 26 spreads in the circumferential direction Dc with respect to the axis Ar, and thus, guides the steam which has flowed in from the diffuser space 26*s* to the exhaust port 31.

Figure 2:
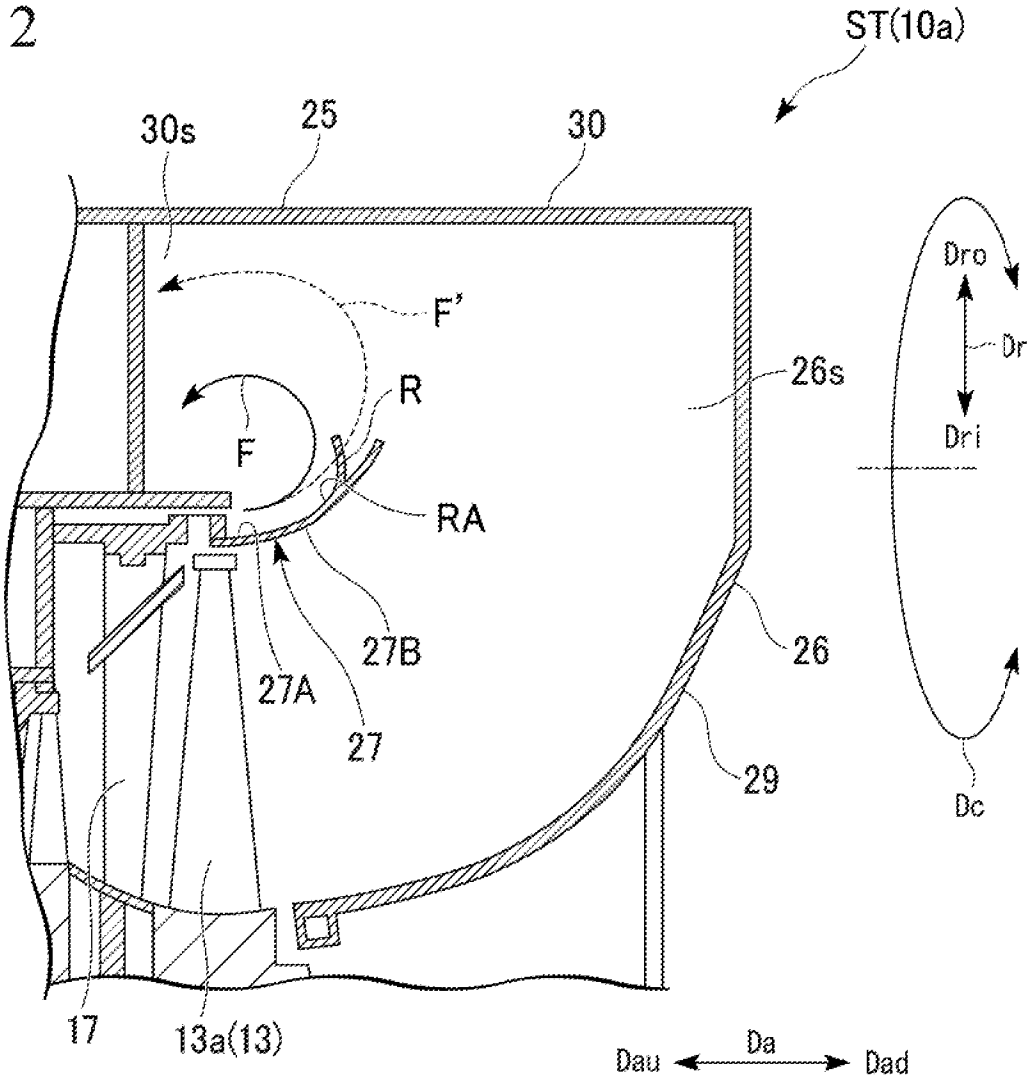
FIG. 2 is an enlarged view of a main portion of the steam turbine in the first embodiment of the present invention.

Next, a detailed configuration of the outer diffuser 27 in the present embodiment will be described with reference to FIG. 2. As shown in FIG. 2, a surface of the outer diffuser 27 facing the radially outer side. Dro is an outer peripheral surface 27A. In addition, a surface of the outer diffuser 27 facing the radially inner side Dri is an inner peripheral surface 27B. A length (that is, a thickness of the outer diffuser 27) between the outer peripheral surface 27A and the inner peripheral surface 27B is constant over the entire extension region of the outer diffuser 27.

A turning portion R is formed on the outer peripheral surface 27A of the outer diffuser 27. The turning portion R is protruded from a portion of the outer peripheral surface 27A of the outer diffuser 27 which is close to one side in the axial direction Da, and extends so as to intersect with a direction in which the outer diffuser 27 extends. More specifically, the turning portion R extends from the outer peripheral surface 27A of the outer diffuser 27 toward the other side from the one side in the axial direction Da toward the radially outer side Dro. That is, both surfaces of the turning portion R respectively face both sides in the axial direction Da. In both surfaces of the turning portion R, the surface on the other side in the axial direction Da is a turning surface RA. The turning surface RA is recessed in a curved shape toward the one side in the axial direction Da. Although the details will be described later, the turning surface RA is effective for turning a fluid. (steam) flowing along the outer peripheral surface 27A of the outer diffuser 27 toward the other side in the axial direction Da.

Subsequently, a behavior of the steam in the diffuser space 26*s* will be described with reference to FIG. 2 again. The steam which has flowed out from the last rotor blade row 13*a* of the turbine rotor 11 flows into the diffuser space 26*s*. A pressure of the steam which has flowed into the diffuser space 26*s* is recovered by an action of the diffuser 26 and the steam hits an inner surface of the exhaust casing 25. Accordingly, direction in the flow of the steam is changed. More specifically, the steam which has passed through the diffuser space 26*s* flows from the radially inner side Dri toward the radially outer side Dro, and thereafter, flows from the one side (axially downstream side Dad) toward the other side (axially upstream side Dau) in the axial direction Da.

As shown by a solid line arrow in FIG. 2, a portion of the steam flowing from the one side toward the other side in the axial direction Da forms the circulation flow Fin the exhaust space 30*s*. The circulation flow F is formed in a region on the other side in the axial direction Da from the turning surface RA of the turning portion R. The circulation flow F turns in a direction from the outer peripheral surface 27A of the outer diffuser 27 toward the turning surface RA. In the steam which has flowed into the exhaust space 30*s*, a component excluding the circulation flow F is discharged to the outside from the exhaust port 31.

Here, in the present embodiment, the outer diffuser 27 includes the turning portion R (turning surface RA). Accordingly, a region in which the circulation flow F is formed can be limited only to the other side in the axial direction Da front the turning surface RA. More specifically, the steam flowing along the outer peripheral surface 27A is turned by the turning surface RA, and, thus, the steam flows from one side toward the other side in the axial direction Da. Accordingly, it is possible to reduce a magnitude of the circulation flow F in the vicinity of the turning surface RA.

In a case where the turning portion R is not provided in the outer diffuser 27, the circulation flow F develops toward the one side in the axial direction Da from a position where the turning portion R is provided (broken line arrow F' in FIG. 2). In a case where the circulation flow F' is developed, an exhaust area is limited, and the flow of the steam toward the exhaust port 31 is limited. Accordingly, an exhaust loss of the steam turbine ST increases. However, in the present embodiment, the turning portion R (turning, surface RA) is provided. Therefore, the development of the circulation flow F is limited, and it is possible to reduce the exhaust loss of the steam turbine ST.

Figure 3:
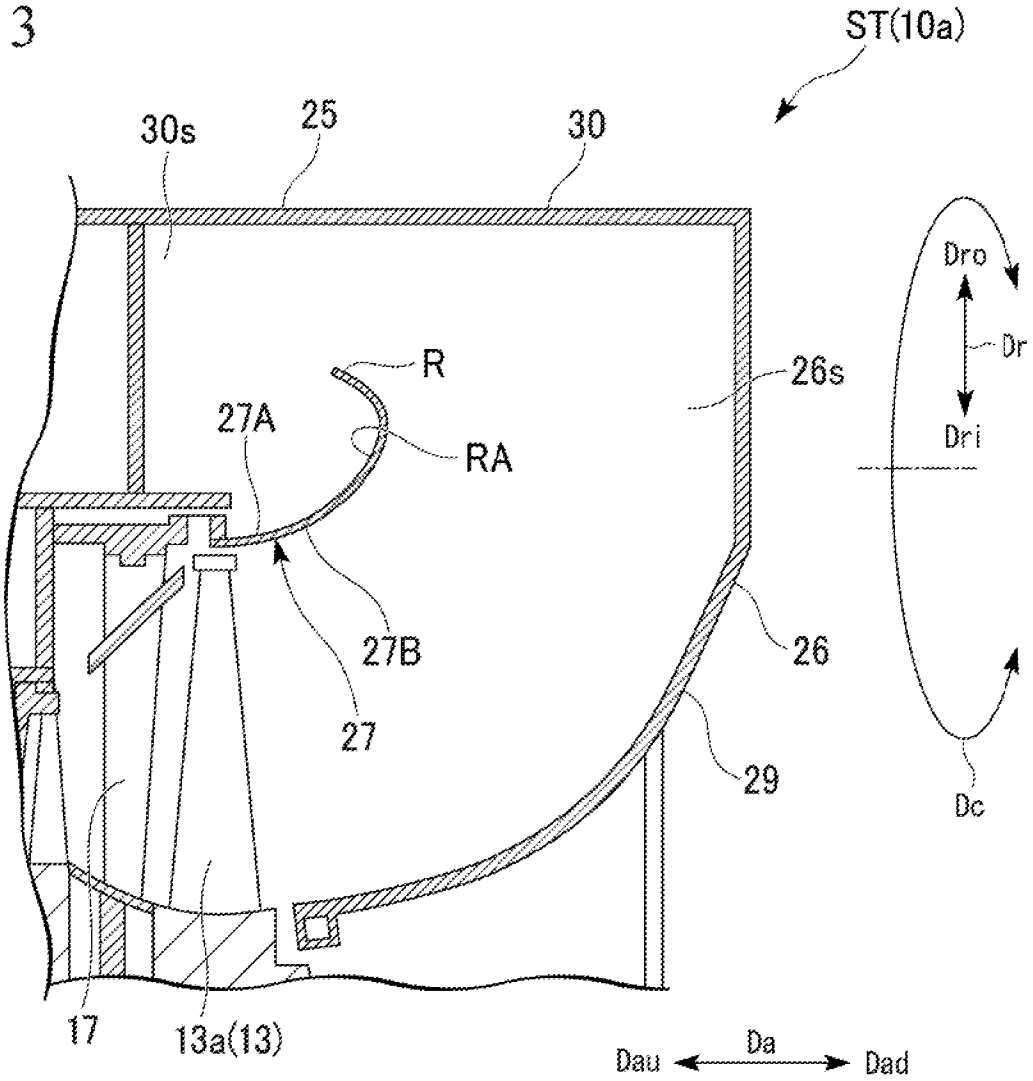
FIG. 3 is an enlarged view of a main portion of a steam turbine showing a modification example of the first embodiment of the present invention.

Hereinbefore, the first embodiment of the present invention is described with reference to FIGS. 1 and 2. The above-described configuration is an example, and various notifications and improvements can be made to the configuration. For example, as shown in FIG. 3, it is possible to adopt a configuration in which the turning portion R is formed on one end portion of the outer diffuser 27 in the axial direction Da so as to be continued into the outer diffuser 27. In a case where the configuration is adopted, the outer diffuser 27 can be obtained simply by bending a plate material forming the outer diffuser 27 to form the turning portion R. That is a manufacturing process can be simplified, a cost can be reduced, and a delivery period can be shortened. Furthermore, the processing can also be easily applied to the existing steam turbine ST.

Second Embodiment

Figure 4:
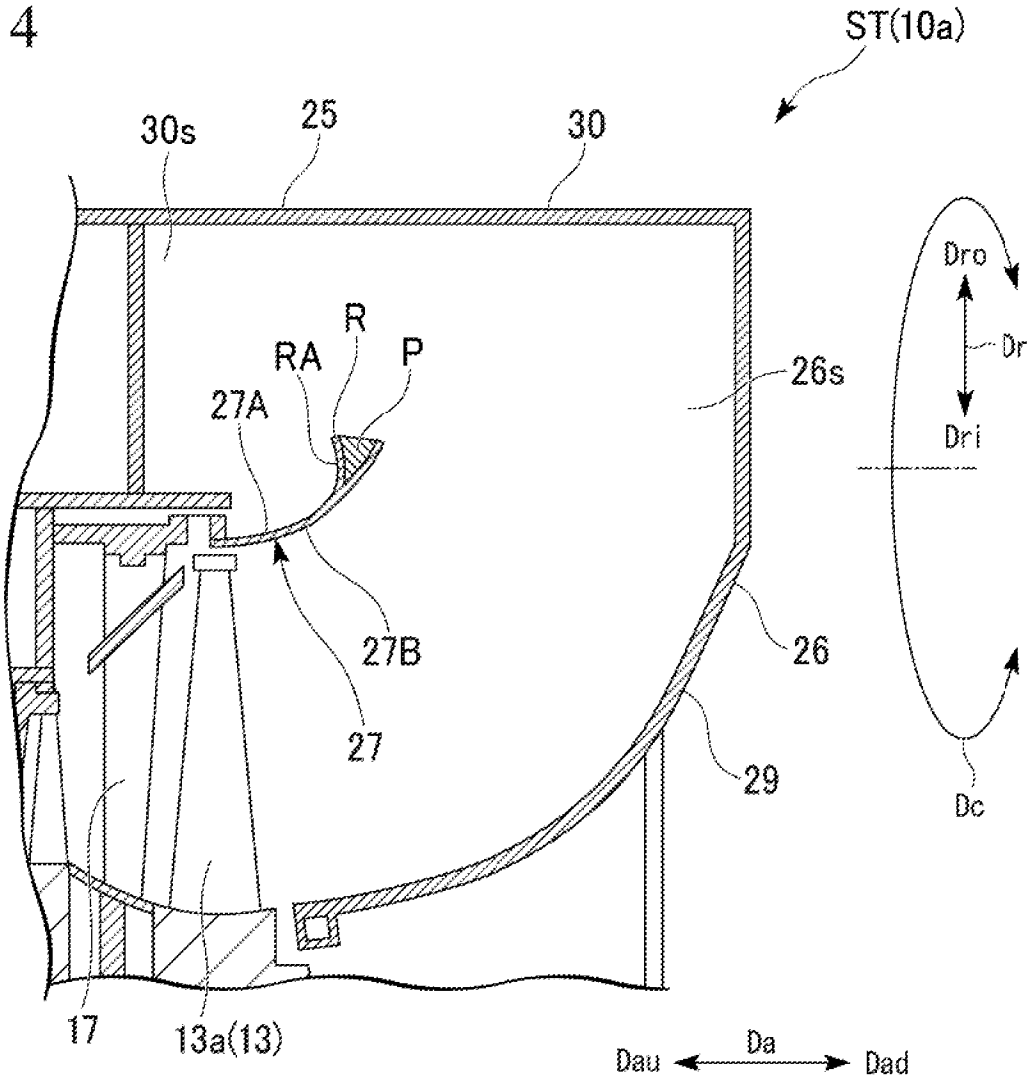
FIG. 4 is an enlarged view of a main portion of a steam turbine in a second embodiment of the present invention.

Next, a second embodiment of the present invention will be described with reference to FIG. 4. The same reference signs are assigned to the same configurations as those of the first embodiment, and detailed descriptions thereof are omitted. As shown in FIG. 4, in the present embodiment, a solid portion P is formed in a region (a region between the turning surface RA and the inner peripheral surface 27B) between the turning portion R and the outer diffuser 27 to fill the region. That is, the turning portion R has an integral block shape with respect to the outer diffuser 27. A surface on the other side of the solid portion P in the axial direction Da is a turning surface RA. An end face on the outer peripheral side of the solid portion P is flat.

According to this configuration, similarly to the first embodiment, the turning surface RA is provided. Therefore, the region in which the circulation flow F is formed can be limited only to the other side in the axial direction Da from the turning surface RA. More specifically, the steam flowing along the outer peripheral surface 27A is turned by the turning surface RA, and, thus, the steam flows from one side toward the other side in the axial direction Da. That is, a flow direction of the steam which is turned by the turning surface RA and a flow direction of the steam which hits the exhaust casing 25 after being discharged from the diffuser space 26*s* can be made substantially the same as each other. Accordingly, it is possible to reduce the magnitude of the circulation flow in the vicinity of the turning surface RA. Moreover, since the solid portion P is provided, the turning portion R can be integrally formed with the outer diffuser 27 to be one member. Accordingly, the manufacturing process can be also be simplified.

Hereinbefore, the second embodiment of the present invention is described with reference to FIG. 4. The above-described configuration is an example, and various modifications and improvements can be made to the configuration.

Third Embodiment

Figure 5:
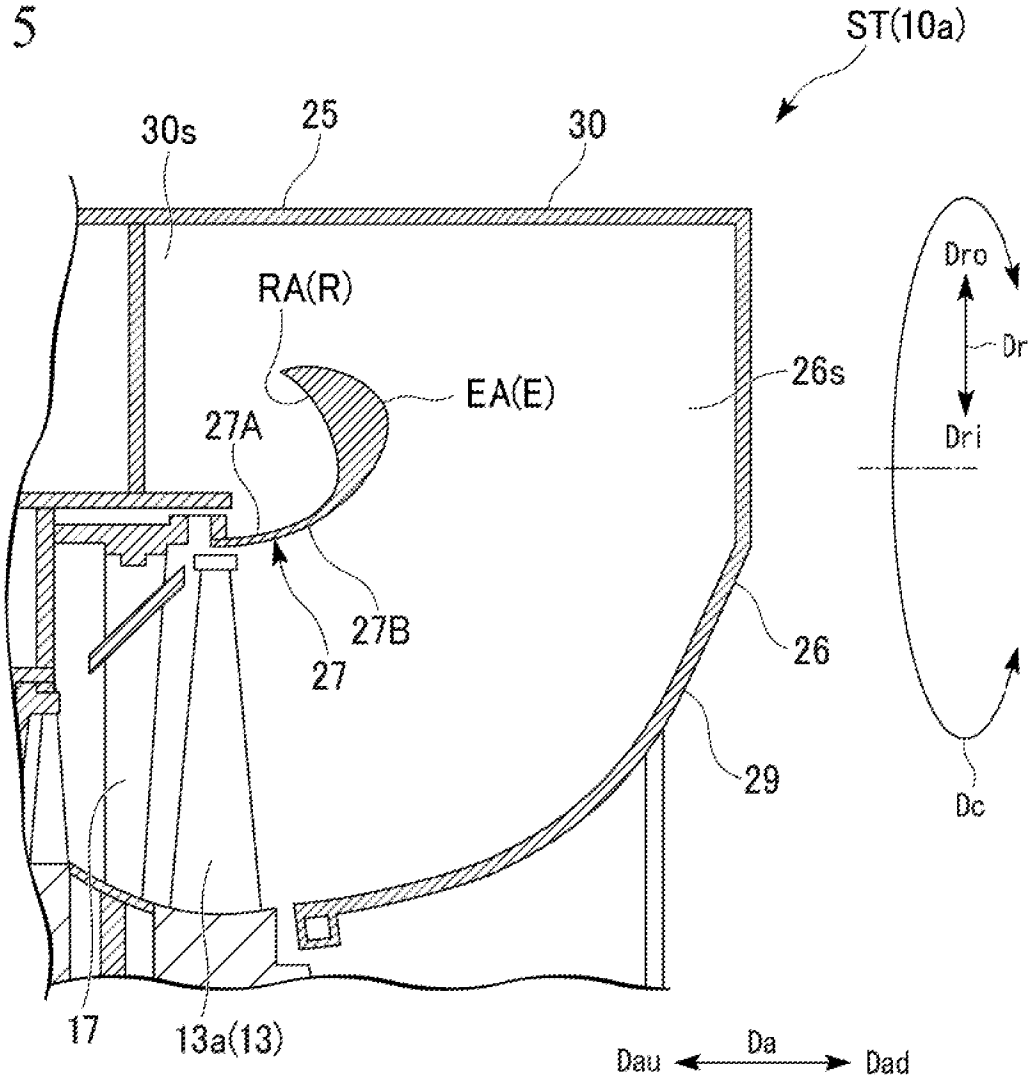
FIG. 5 is an enlarged view of a main portion of a steam turbine in a third embodiment of the present invention.

Next, a third embodiment of the present invention will be described with reference to FIG. 5. The same reference signs are assigned to the same configurations as those of the respective embodiments, and detailed descriptions thereof are omitted. As shown in FIG. 5, the inner peripheral surface 27B has a curvature radius smaller than that of the turning surface RA in a cross-sectional view including the axis Ar. In other words, the inner peripheral surface 27B swells toward one side of the axial direction Da. The inner peripheral surface 27B extends in a substantially are shape from an end portion of the outer diffuser 27. An outer peripheral end edge of the inner peripheral surface 27B intersects with an outer peripheral end edge of the turning surface RA. That is, the inner peripheral surface 27B and the turning surface RA extend in substantially the same direction in the outer peripheral end edge.

According to this configuration, a flow direction of the steam flowing along the inner peripheral surface 27B and a flow direction of the steam flowing along the turning surface RA can be made substantially the same as each other in the outer peripheral end edge. Thereby, a mixing loss of the fluid flowing along the inner peripheral surface 27B and the fluid flowing along the turning surface RA can be reduced. Therefore, an interference between the circulation flow F and the flow of the steam flowing along the turning surface RA can be reduced, and it is possible to further reduce the exhaust loss of the steam turbine ST.

Hereinbefore, the third embodiment of the present invention is described with reference to FIG. 5. The above-described configuration is an example, and various modifications and improvements can be made to the configuration.

Fourth Embodiment

Figure 6:
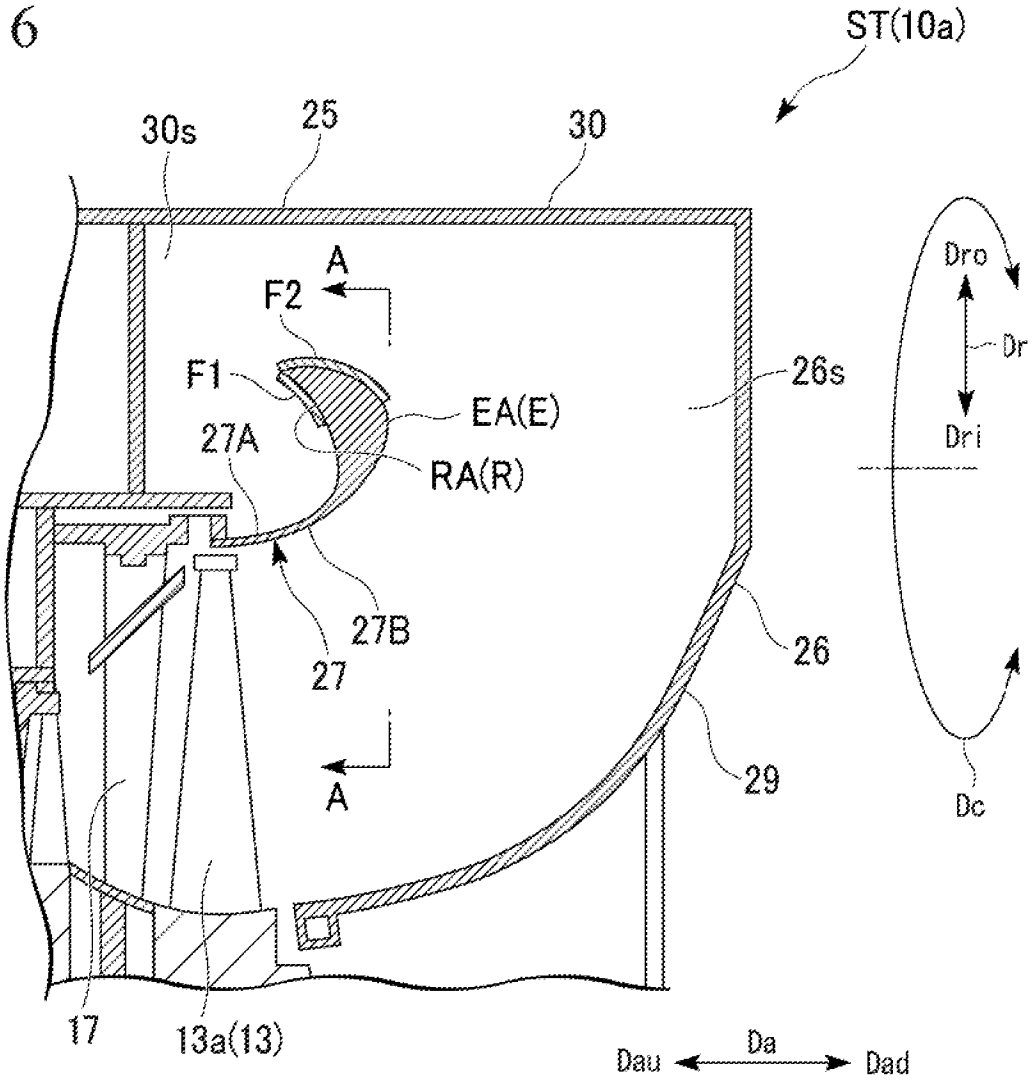
FIG. 6 is an enlarged view of a main portion of a steam turbine in a fourth embodiment of the present invention.
Figure 7:
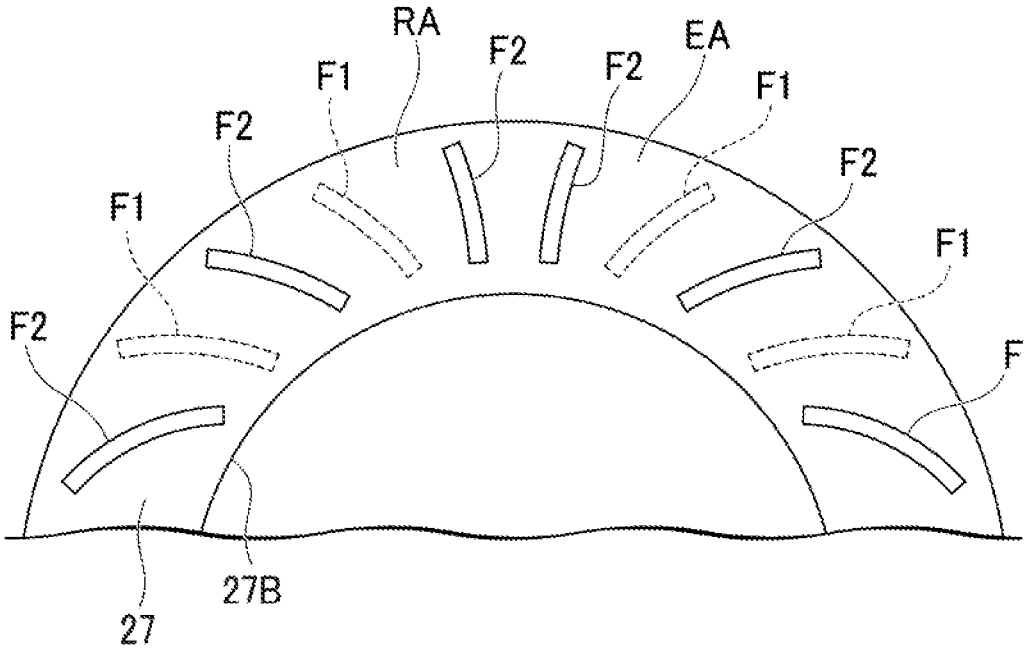
FIG. 7 is a sectional view taken along line A-A of FIG. 6.

Next, a fourth embodiment of the present invention will be described with reference to FIGS. 6 and 7. The same reference signs are assigned to the same configurations as those of the respective embodiments, and detailed descriptions thereof are omitted. As shown in FIGS. 6 and 7, in the present embodiment, rectifying fins are formed on each of the turning surface RA and the inner peripheral surface 27B described in the third embodiment.

A plurality of first rectifying fins F1 extending in the radial direction Dr are formed on the turning surface RA at intervals in the circumferential direction De. The first rectifying fins F1 are erected on the turning surface RA so as to be perpendicular to the turning surface RA. A stand-up length (stand-up length from the turning surface RA of the first rectifying fin F1) of each first rectifying fin F1 gradually increases outward from the radially inner side Dri. The first rectifying fin F1 extends from one end portion of the outer diffuser 27 in the axial direction Da to the outer peripheral end of the turning portion R.

A plurality of second rectifying fins F2 extending in the radial direction Dr are provided at intervals in the circumferential direction Dc in a region on one side of the inner peripheral surface 27B in the axial direction Da. The second rectifying fins F2 are erected on the inner peripheral surface 27B so as to be perpendicular to the inner peripheral surface 27B. A stand-up length of each second rectifying fin F2 gradually increases toward the radially outer side Dro from the radially inner side Dri. The second rectifying fin F2 is provided only in a partial region including the outer peripheral end portion of the inner peripheral surface 27B. More specifically, the second rectifying fin F2 is provided only in a region of the inner peripheral surface 27B facing the radially outer side Dro. Furthermore, in the present embodiment, a position where the second rectification fin F2 is provided on the inner peripheral surface 27B is different from the position of the first rectification fin F1 an the turning surface RA.

As shown in FIG. 7, when viewed from the axial direction Da, the first rectifying fins F1 and the second rectifying fins F2 are alternately arranged in the circumferential direction Dc. Each first rectifying fin F1 and each second rectifying fin F2 have an inclination angle with respect to the radial direction Dr. Furthermore, as the first rectifying fin F1 (or the second rectifying fin F2) is provided at a position separated from a vertical direction, the inclination angle with respect to the radial direction Dr increases.

Here, a circumferential component accompanying the rotation of the turbine rotor 11 is included in the flow direction of the steam discharged front the diffuser space 26*s*. According to the configuration, since the first rectifying fins F1 are provided on the turning surface RA. Therefore, the circumferential component of the steam discharged from the diffuser space 26*s* and the circumferential component of the circulation flow flowing along the turning surface RA can be made substantially the same as each other. Accordingly, an interference between the steam discharged from the diffuser space 26*s* and the circulation flow can be reduced, and it is possible to reduce a mixing loss. Therefore, it is possible to further reduce the exhaust loss of the steam turbine ST.

Moreover, according to the configuration, the first rectifying fins F1 and the second rectifying fins F2 are provided in each of both surfaces (turning surface RA and inner peripheral surface 27B) of the outer diffuser 27. Accordingly, the flow along the inner peripheral surface 27B and the circulation flow along the turning surface RA can be made closer to each other. Therefore, the interference between the steam discharged from the diffuser space 26*s* and the circulation flow can be further reduced.

Hereinbefore, the fourth embodiment of the present invention is described with reference to FIG. 6. The above-described configuration is an example, and various modifications and improvements can be made to the configuration. For example, the first rectifying fin F1 and the second rectifying fin F2 may be provided at the same position as each other in the circumferential direction Dc. Furthermore, extension directions of the first rectifying fin F1 and the second rectifying fin F2 may intersect each other.

INDUSTRIAL APPLICABILITY

According to the steam turbine, it is possible to reduce the exhaust loss.

REFERENCE SIGNS LIST

10*a*: first steam turbine section
10*b*: second steam turbine section
11: turbine rotor
12: rotor shaft
13: rotor blade row
13*a*: last rotor blade row
17: stator blade row
18: bearing
19: steam inflow pipe
20: casing
21: inner casing
25: exhaust casing
26: diffuser
26*s*: diffuser space
27: outer diffuser (flow guide)

27A: outer peripheral surface
27B: inner peripheral surface
29: inner diffuser
30: outer casing
30*s*: exhaust space
31: exhaust port
F1: first rectifying fin
F2: second rectifying fin
R: turning portion
RA: turning surface
ST: steam turbine
Ar: axis

The invention claimed is:

1. A steam turbine comprising:

a rotor which is rotatable around an axis by steam supplied to the rotor and which is configured to exhaust the steam from one side in an axial direction;

an inner casing surrounding the rotor from an outer peripheral side;

an outer casing surrounding the rotor and the inner casing and defining an exhaust chamber between the inner casing and the outer casing, the steam being exhausted to the exhaust chamber;

a flow guide which has a tubular shape surrounding the axis and which is installed on one end portion of the inner casing in the axial direction in the exhaust chamber so as to guide the steam discharged from the rotor; and a turning portion which is formed on the flow guide, wherein the flow guide includes an inner peripheral surface which is formed so that the diameter thereof is enlarged as the inner peripheral surface is separated further from the inner casing to one side in the axial direction, and an outer peripheral surface which is formed so that the diameter thereof is enlarged as the outer peripheral surface is separated further from the inner casing to the one side in the axial direction, and wherein the turning portion includes a turning surface which is connected to the outer peripheral surface and which is formed so as to turn a fluid flowing along the outer peripheral surface toward the other side in the axial direction, and wherein the turning portion is protruded from a portion of the outer peripheral surface which is close to the one side in the axial direction, and extends so as to intersect with a direction in which the flow guide extends.

2. The steam turbine according to claim 1, wherein the turning surface is extended from the one side to the other side in the axial direction as the turning surface goes from a radially inner side toward a radially outer side with respect to the axis.

3. The steam turbine according to claim 1, further comprising:

a solid portion which is formed in a region between the turning surface and the inn peripheral surface so that the region is filled with the solid portion.

4. The steam turbine according to claim 1, wherein, in a cross-sectional view including the axis, the inner peripheral surface has a curvature radius smaller than that of the turning surface, and an outer peripheral end edge of the turning surface intersects an outer peripheral end edge of the inner peripheral surface.

5. The steam turbine according to claim 1, further comprising:

a plurality of first rectifying fins which are formed on the turning surface and which are extended in a radial direction of the axis.

6. The steam turbine according to claim 1, further comprising:

a plurality of second rectifying fins which are formed on the inner peripheral surface and which are extended in a radial direction of the axis.

* * * * *